US005313255A

United States Patent [19]

Taniguchi et al.

[11] Patent Number: 5,313,255

[45] Date of Patent: May 17, 1994

[54] STRUCTURE OF SUPPORTING AN IMAGE BEARING MEMBER

[75] Inventors: Susumu Taniguchi; Hiroshi Kubota, both of Osaka, Japan

[73] Assignee: Mita Industrial Co., Ltd, Osaka, Japan

[21] Appl. No.: 87,410

[22] Filed: Jul. 8, 1993

[30] Foreign Application Priority Data

Jul. 13, 1992 [JP] Japan ..... 4-185546

[51] Int. Cl.[5] ..... G03G 15/00

[52] U.S. Cl. ..... 355/211; 355/225

[58] Field of Search ..... 355/200, 210, 211, 221, 355/225

[56] References Cited

U.S. PATENT DOCUMENTS 2,825,814 3/1958 Walkup .

4,563,076 1/1986 Takahashi et al. ..... 355/210

FOREIGN PATENT DOCUMENTS 2-83572 3/1990 Japan ..... 355/211

*Primary Examiner*—Joan H. Pendegrass

*Attorney, Agent, or Firm*—Antonelli, Terry, Stout & Kraus

[57] ABSTRACT

The present invention discloses a structure of supporting an image bearing member in which the tip portions of support pins inwardly projecting from side plates of a housing, come in contact with the bottoms of support-pin introducing holes in the image bearing member, so that tension applied to a grid electrode disposed opposite to the image bearing member is received by rigidity obtained by the image bearing member and the support pins. Predetermined gaps are formed between the side plates and the flange portions of the image bearing member.

9 Claims, 3 Drawing Sheets

STRUCTURE OF SUPPORTING AN IMAGE BEARING MEMBER

BACKGROUND OF THE INVENTION

1. Field of the Invention

The present invention relates to a structure of supporting an image bearing member, and more particularly to a structure of supporting the image bearing member of an image bearing unit in an image forming apparatus, in which the image bearing member is supported, at opposite sides thereof, by a pair of side plates formed at the housing of the image bearing unit, and in which a grid electrode for a corona discharger is installed between the side plates.

2. Description of the Related Art

In an image forming apparatus such as a copying machine, a laser beam printer or the like, there has been proposed one having an image bearing unit in which an image bearing member such as a photoreceptor drum or the like is rotatably held in the housing of the image bearing unit. In such an image forming apparatus having the image bearing unit above-mentioned, upon completion of a predetermined amount of image forming operation, the image bearing unit can be removed from the main body of the image forming apparatus and replaced with a new image bearing unit. This advantageously facilitates the mounting of a new image bearing unit.

As the image bearing unit of the type above-mentioned, the following arrangement has been proposed. That is, an image bearing member is interposed between a pair of side plates formed at the housing of the image bearing unit with predetermined gaps formed between the image bearing member and the side plates, and shafts inwardly projecting from the side plates are inserted in and passed through flange portions of the image bearing member at opposite sides thereof so that the image bearing member is rotatably supported. Further, a grid electrode of the scorotron type for a corona discharger is installed between the pair of side plates with a predetermined tension applied to the grid electrode.

In the image bearing unit having the arrangement above-mentioned, a structure of supporting the image bearing member is arranged such that the shafts inwardly projecting from the side plates are inserted in and passed through the flange portions of the image bearing member. Accordingly, the tension applied to the grid electrode may cause the side plates to be inwardly deformed and come in slide contact with opposite sides of the image bearing member. This disadvantageously increases the driving torque of the image bearing member and generates noise.

In view of the problems above-mentioned, the present invention is proposed with the object of providing a structure of supporting an image bearing member which prevents a pair of side plates holding the image bearing member from being inwardly deformed, thus preventing an increase in the driving torque of the image bearing member, as well as generation of noise.

SUMMARY OF THE INVENTION

A structure of supporting the image bearing member of an image bearing unit in an image forming apparatus, in which the image bearing member is supported, at opposite sides thereof, by a pair of side plates formed at the housing of the image bearing unit and in which a grid electrode for a corona discharger is installed between the side plates, is characterized in that: support pins as restrained from being axially moved, inwardly project from the side plates and are introduced into support-pin introducing holes formed in flange portions of the image bearing member at opposite sides thereof, so that the image bearing member is rotatably supported; and that the tips of the support pins come in contact with the bottoms of the support-pin introducing holes with gaps formed between the side plates and the flange portions.

The structure of supporting an image bearing member having the arrangement above-mentioned, prevents the side plates of the housing from coming in slide contact with the flange portions of the image bearing member, thus preventing an increase in the driving torque of the image bearing member, as well as generation of noise.

Preferably, one of the side plates has an engagement projection with which one end of the grid electrode is engaged, and the other side plate has a resilient member which applies tension to the grid electrode with the other end of the grid electrode held by the resilient member.

According to the arrangement above-mentioned, a desired tension can be applied to the grid electrode by the biasing force of the resilient member.

Preferably, the side plates have grid-electrode positioning surfaces, and the resilient member applies a biasing force such that the grid electrode is pressed onto the positioning surfaces.

According to the arrangement above-mentioned, the ends of the grid electrode are pressed onto the positioning surfaces, thus precisely positioning the grid electrode. Accordingly, the distance between the grid electrode and the image bearing surface of the image bearing member can be uniformly maintained.

Preferably, the resilient member is formed by a leaf spring, and the support pins inwardly projecting from the side plates have flange portions which are fixed, together with the leaf spring, to the side plates with screws.

According to the arrangement above-mentioned, the same screws are used for fixing the support pins and the leaf spring to the side plates, thus simplifying the assembling steps.

Preferably, the side plates extend as projecting from the housing such that the image bearing surface of the image bearing member is exposed to the outside from the housing.

According to the arrangement above-mentioned, the corona discharger can be attached at the outside of the image bearing unit, i.e., at the side of the main body of an image forming apparatus in which the image bearing unit is housed. Accordingly, the image bearing unit can be composed of articles of consumption alone.

According to the arrangement above-mentioned, the grid electrode is preferably installed between the side plates at the free end sides thereof.

Preferably, the tip portions of the support pins are semi-spherical and the bottoms of the support-pin introducing holes are semi-spherical following the spherical surfaces of the tip portions of the support pins.

The arrangement above-mentioned advantageously reduces the slide resistance between the tip portions of the support pins and the bottoms of the support-pin introducing holes.

For the same reason, it is preferred that the tip portions of the support pins are tapered and that the bottoms of the support-pin introducing holes are tapered along the tapering surfaces of the tip portions of the support pins.

Preferably, the image bearing member has a casing main body and flange portions formed at both ends of the main body, the flange portions being made separately from the main body.

BRIEF DESCRIPTION OF THE DRAWINGS

These and other features, objects and advantages of the present invention will be more fully apparent from the following detailed description set forth below when taken in conjunction with the accompanying drawings and wherein.

DETAILED DESCRIPTION OF THE PREFERRED EMBODIMENTS

The following description will discuss in detail the present invention with reference to the attached drawings illustrating embodiments thereof.

Figure 1:
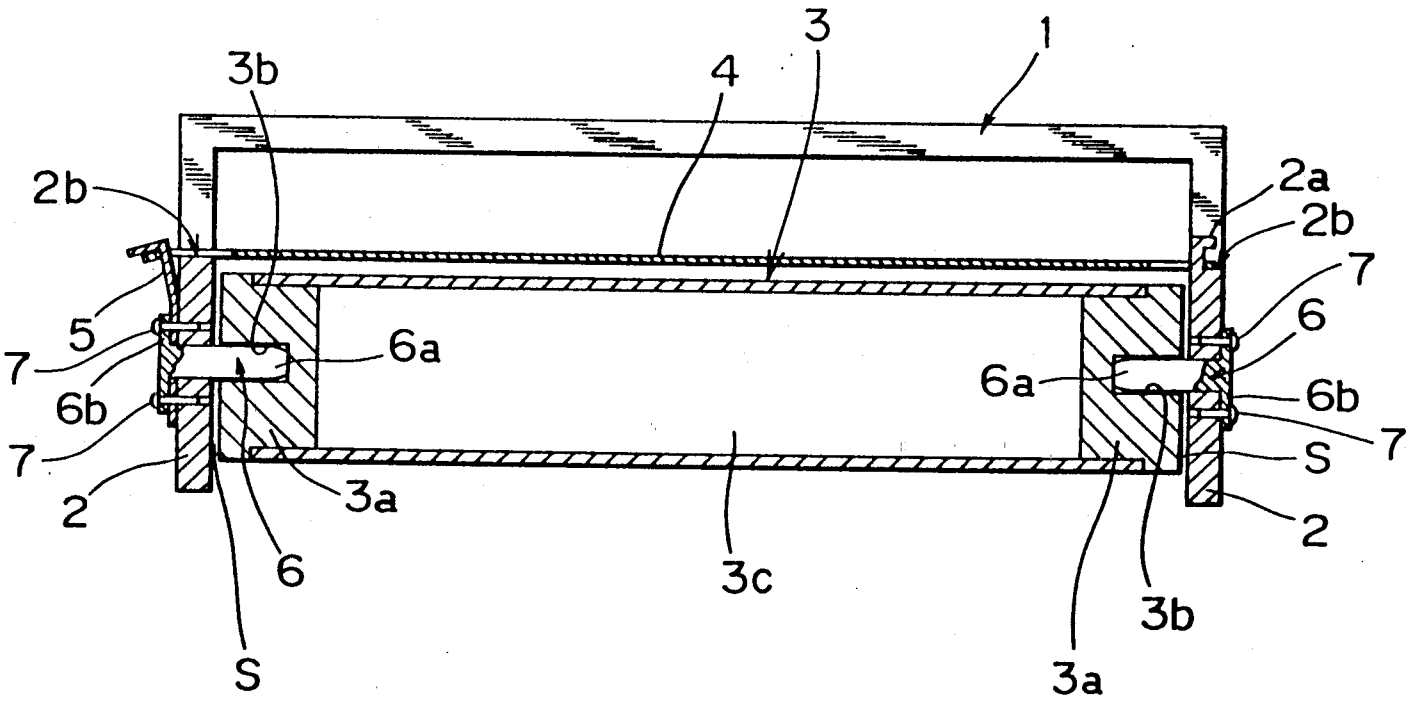
FIG. 1 is a section view of a drum unit serving as an image bearing unit employing the structure of supporting an image bearing member according to an embodiment of the present invention.
Figure 2:
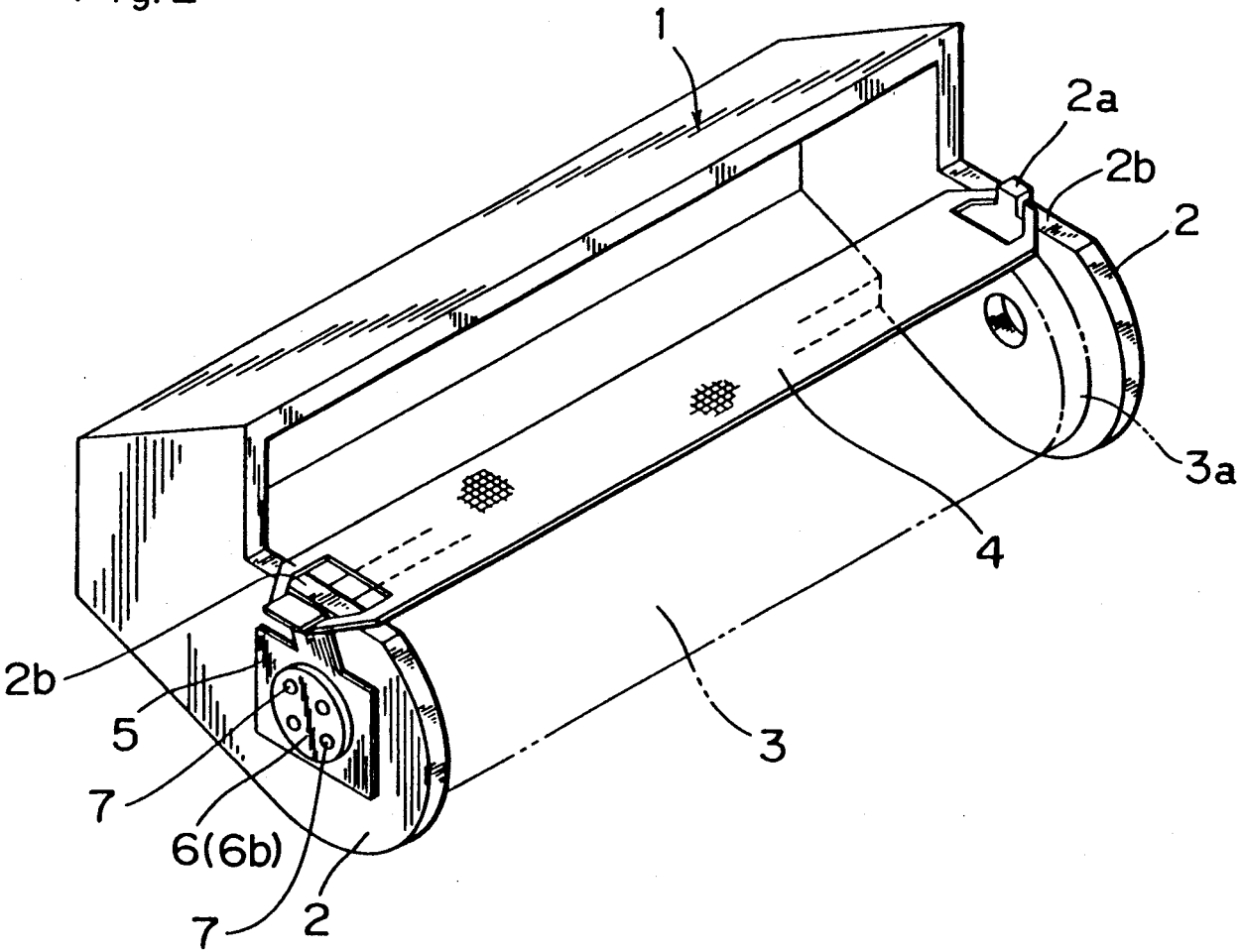
FIG. 2 is a perspective view of the drum unit shown in FIG. 1.

FIG. 1 is a section view of a drum unit serving as an image bearing unit employing the structure of supporting an image bearing member according to an embodiment of the present invention. FIG. 2 is a perspective view of the drum unit shown in FIG. 1.

In the drum unit, a photoreceptor drum 3 serving as the image bearing member is rotatably supported between a pair of side plates 2 formed at a housing 1 with a predetermined space provided between the side plates 2.

In this embodiment, the photoreceptor drum 3 suitably has a casing main body 3c and flange portions 3a respectively formed at both ends of the main body 3c, the flange portions 3a being formed separately from the main body 3c. A grid electrode 4 for a corona discharger (not shown) is disposed between the pair of side plates 2.

The housing 1 is a molded article in a unitary structure made of synthetic resin. The side plates 2 extend as projecting from the housing 1 such that the image bearing surface of the photoreceptor drum 3 is exposed to the outside from the housing 1.

In this embodiment, the corona discharger can be attached at the outside of the image bearing unit or photoreceptor drum 3, i.e., at the side of the main body of an image forming apparatus in which the photoreceptor drum 3 is housed. Accordingly, the image bearing unit can be composed of articles of consumption alone.

In the housing 1, one of the side plates 2 is provided on the top thereof with an engagement projection 2a with which one end of the grid electrode 4 is engaged, and the other side plate 2 is provided at the outer side surface thereof with a leaf spring 5 serving as a resilient member with which the other end of the grid electrode 4 is engaged. The grid electrode 4 is installed between the side plates 2 at the free end sides thereof. A predetermined tension is applied to the grid electrode 4 by the resilient force of the leaf spring 5. Thus, in this embodiment, a desired tension can be applied to the grid electrode 4 by the biasing force of the leaf spring 5.

In this embodiment, the side plates 2 have positioning surfaces 2b for the grid electrode 4, and the leaf spring 5 applies the tension above-mentioned to the grid electrode 4 while exerting a biasing force in such a direction that the ends of the grid electrode 4 are pressed onto the positioning surfaces 2b. As a result, the ends of the grid electrode 4 are pressed onto the positioning surfaces 2b so that the grid electrode 4 can be precisely positioned. Accordingly, the distance between the grid electrode 4 and the image bearing surface of the photoreceptor drum 3 can be uniformly maintained.

Support pins 6 for rotatably supporting the photoreceptor drum 3 are respectively inserted in and passed through the pair of side plates 2. Each of the support pins 6 has a shank 6a and a flange portion 6b at the base end of the shank 6a. The tips of the shanks 6a project inwardly of the side plates 2. The flange portions 6b are fixed to the side plates 2 with screws 7, thus fixing the flange portions 6b as prevented from being moved in the axial direction of the support pins 6. The support pins 6 are relatively rotatably fitted in support-pin introducing holes 3b formed in the flange portions 3a of the photoreceptor drum 3 at the opposite sides thereof. The tips of the support pins 6 come in contact with the bottoms of the support-pin introducing holes 3b. With the tips of the pins 6 coming in contact with the bottoms of the holes 3b, predetermined gaps S are formed between the flange portions 3a and the side plates 2.

The resilient member or leaf spring 5 is held by and between the flange portion 6b of one support pin 6 and one side plate 2 and fixed, together with the one support pin 6, to the one side plate 2 with the screws 7. Thus, the same screws 7 can be used for fixing the flange portion 6b of the one support pin 6 and the leaf spring 5 to the one side plate 2, thus simplifying the assembling steps.

According to the arrangement above-mentioned, since the tips of the support pins 6 fixed to the side plates 2 come in contact with the bottoms of the support-pin introducing holes 3b in the photoreceptor drum 3, the support pins 6 are restrained from being axially moved. Accordingly, the tension applied to the grid electrode 4 can be received by rigidity obtained by the photoreceptor drum 3 and the support pins 6 fixed to the side plates 2. This prevents the side plates 2 from being inwardly bent, so that the gaps S between the flange portions 3a of the photoreceptor drum 3 and the side plates 2 can be maintained constant at all times. This prevents the side plates 2 from coming in slide contact with the flange portions 3a, thus preventing an increase in the driving torque of the photoreceptor drum 3, as well as generation of noise.

Provision is made such that the side plates 2 are not bent. This prevents the grid electrode 4 from being loosened or improperly positioned at the grid-electrode positioning surfaces 2b. This involves no likelihood that images formed by the photoreceptor drum 3 are lowered in quality.

The drum unit may be embodied as having, in a unitary structure, processing components such as a cleaner for collecting a toner remaining on the photoreceptor drum 3.

According to the present invention, the structure of supporting an image bearing member should not be limited to the embodiment above-mentioned. For example, as shown in FIG. 3, there may be used a support pin 16 having a semi-spherical tip portion 16*a*, and a flange portion 13*a* in which a support-pin introducing hole 13*b* has a bottom 13*c* which is semi-spherical following the spherical surface of the tip portion 16*a* of the support pin 16.

Figure 4:
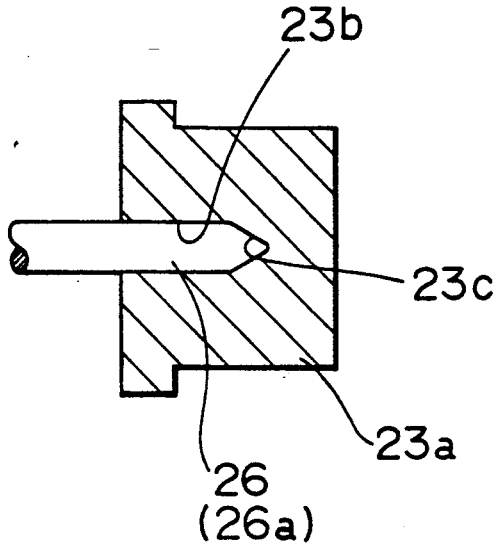
FIG. 4 is a section view of main portions of a further embodiment of the present invention.

Further, as shown in FIG. 4, there may be used a support pin 26 having a tapering tip portion 26*a*, and a flange portion 23*a* in which a support-pin introducing hole 23*b* has a bottom 23*c* which is tapered along the tapering surface of the tip portion 26*a* of the support pin 26.

Figure 3:
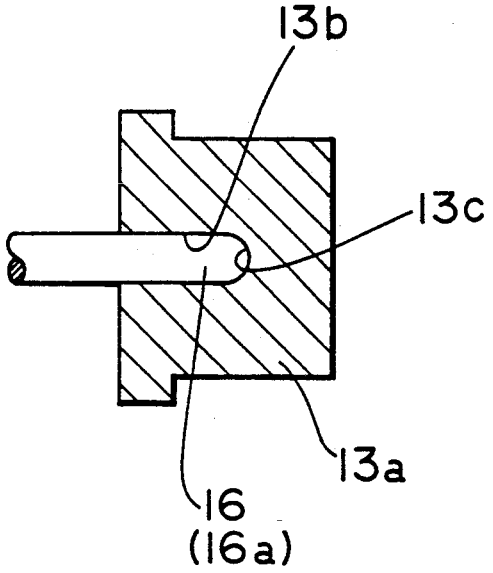
FIG. 3 is a section view of main portions of another embodiment of the present invention.

The arrangements shown in FIGS. 3 and 4 advantageously lower the slide resistance of the tip portions 16*a*, 26*a* of the support pins 16, 26 with the bottoms 13*c*, 23*c* of the support-pin introducing holes 13*b*, 23*b*.

Alternatively, the image bearing member may be made in the form of a photoreceptor belt, instead of the photoreceptor drum 3, or the support pins 6 may be threadedly connected directly to the side plates 2.

Thus, the present invention may be embodied in other specific forms without departing from the spirit or essential characteristics thereof. The embodiments abovementioned are therefore to be considered in all respects as illustrative and not restrictive, the scope of the present invention being indicated by the appended claims rather than by the foregoing description, and all changes which come within the meaning and range of equivalency of the claims are therefore intended to be embraced therein.

We claim:

1. A structure of supporting the image bearing member of an image bearing unit in an image forming apparatus, in which said image bearing member is supported at opposite sides thereof by a pair of side plates formed at the housing of said image bearing unit and in which a grid electrode for a corona discharger is installed between said side plates, characterized in that:

support pins as restrained from being axially moved, inwardly project from said side plates and are introduced into support-pin introducing holes formed in flange portions of said image bearing member at opposite sides thereof, so that said image bearing member is rotatably supported; and the tips of said support pins come in contact with the bottoms of said support-pin introducing holes with gaps formed between said side plates and said flange portions.

2. A structure of supporting an image bearing member according to claim 1, wherein one of the side plates has an engagement projection with which one end of the grid electrode is engaged, and the other side plate has a resilient member which applies tension to said grid electrode with the other end of said grid electrode held by said resilient member.

3. A structure of supporting an image bearing member according to claim 2, wherein the side plates have grid-electrode positioning surfaces, and the resilient member applies a biasing force in such a direction that the grid electrode is pressed onto said positioning surfaces.

4. A structure of supporting an image bearing member according to claim 2, wherein the resilient member is formed by a leaf spring, and the support pins inwardly projecting from the side plates, integrally have flange portions which are secured, together with said leaf spring, to said side plates with screws.

5. A structure of supporting an image bearing member according to claim 1, wherein the side plates extend as projecting from the housing such that the image bearing surface of the image bearing member is exposed to the outside from said housing.

6. A structure of supporting an image bearing member according to claim 5, wherein the grid electrode is installed between the side plates at the free end sides thereof.

7. A structure of supporting an image bearing member according to claim 1, wherein the tip portions of the support pins are semi-spherical and the bottoms of the support-pin introducing holes are semi-spherical following the spherical surfaces of said tip portions of said support pins.

8. A structure of supporting an image bearing member according to claim 1, wherein the tip portions of the support pins are tapered and the bottoms of the support-pin introducing holes are tapered along the tapering surfaces of said tip portions of said support pins.

9. A structure of supporting an image bearing member according to claim 1, wherein the image bearing member has a casing main body and flange portions formed at both ends of said main body, said flange portions being made separately from said main body.

* * * * *